US006701657B1

(12) United States Patent
Hudspeth

(10) Patent No.: US 6,701,657 B1
(45) Date of Patent: Mar. 9, 2004

(54) UNIVERSAL FIREARM CLEANING SYSTEM

(75) Inventor: James Daniel Hudspeth, 1301 Land Rush Dr., Arlington, TX (US) 76012

(73) Assignee: James Daniel Hudspeth, Arlington, TX (US)

( * ) Notice: Subject to any disclaimer, the term of this patent is extended or adjusted under 35 U.S.C. 154(b) by 0 days.

(21) Appl. No.: 10/291,123

(22) Filed: Nov. 8, 2002

(51) Int. Cl.[7] ..... E41A 29/02
(52) U.S. Cl. ..... 42/95; 15/104.062; 15/104.9
(58) Field of Search ..... 42/95; 15/104.5, 15/104.03, 104.04, 104.062, 104.8, 104.9

(56) References Cited

U.S. PATENT DOCUMENTS

| | | | | | |
|---|---|---|---|---|---|
| 937,729 | A | * | 10/1909 | Upham | 42/95 |
| 1,560,441 | A | * | 11/1925 | Trosper | |
| 2,263,845 | A | * | 11/1941 | Hartsell | |
| 4,014,062 | A | * | 3/1977 | Scott et al. | 15/104.04 |
| 5,038,525 | A | * | 8/1991 | Gardner | 15/104.03 |
| 5,123,763 | A | * | 6/1992 | Simmons | 15/104.04 |
| 5,398,461 | A | * | 3/1995 | Rose | 15/104.04 |
| 5,815,975 | A | * | 10/1998 | Rambo et al. | 42/95 |
| 5,983,550 | A | * | 11/1999 | Skaar | 42/95 |

FOREIGN PATENT DOCUMENTS

| | | | | |
|---|---|---|---|---|
| SU | 1820170 A1 | * | 6/1993 | 42/95 |

* cited by examiner

*Primary Examiner*—Stephen M. Johnson

(57) ABSTRACT

A universal firearm cleaning system 4 is presented that includes a universal barrel fastener 6 and waste container 8 to catch cleaning patches and the splattering solvent that exits the barrel bore during the firearm cleaning process. The fastener 6 attaches the container 8 to the muzzle or breech of the gun barrel using tongs that can easily accommodate various diameters of gun barrels and virtually any sight system. The waste container 8 is attached to the fastener 6 and has removable end caps. One end cap 42 closes the container. The other end cap 38 forms an opening for receiving the end of the barrel of a gun and connects to the barrel fastener 6. When a cleaning rod is pushed through the bore 16, the waste container 8 catches the solvent, splatter and other debris that exits the bore 16. The end cap 42 may then be removed to easily clean out the waste container 8.

18 Claims, 3 Drawing Sheets

UNIVERSAL FIREARM CLEANING SYSTEM

CROSS-REFERENCED TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Technical Field

This invention relates in general to accessories for firearms and, more particularly, to a firearm cleaning system with a container for waste collection and universal barrel fastener.

2. Description of the Related Art

The most important part of firearm maintenance is properly cleaning the barrel of the gun. When a bullet is fired through a barrel's bore, many small particles such as gunpowder residue or bullet shavings are deposited throughout the bore. With each successive bullet firing, these fouling particles are essentially "ironed" into the bore. This typically results in reducing the accuracy of rifles and pistols. The only way to maintain firearm accuracy and increase the life of the barrel is to remove these particles by frequently cleaning the bore.

A rifle gun bore is typically cleaned with a cleaning rod, brush and patches or by a cable that pulls a bristled swab through the bore. To clean a rifled bore, one must first remove the bolt from the action to gain access to both ends of the bore. A solvent soaked patch is then pushed through the bore with a cleaning rod equipped with a jag tip. A brush tip on the cleaning rod is then used to remove the stubborn particles. The wire bristles are particularly effective at reaching the tight spaces between the lands and the grooves, which make up the rifling. If the bullet being fired is manufactured with a copper jacket, copper particles are being deposited into the bore. A copper fouled bore must soak in a copper solvent long enough for the solvent to react with the copper particles in the gun barrel. It is important to follow the directions when using a copper solvent. Once the particles and residue have been loosened from the bore walls, fresh cleaning patches are pushed through the bore. The soft cleaning patch acts as a squeegee to push the chemicals and fouling out of the bore. Fresh patches of the appropriate size are continuously pushed through the bore one at a time until they come out clean. With each pass of the cleaning rod, the solvent, debris and patches spill out of the muzzle. This debris and solvent can soil clothing, carpet, walls and other surrounding surfaces as well as deposit a mound of trash to clean up at the end of the process. The brush produces a very widespread splattering effect upon exiting the bore. In addition to the physical litter, the chemicals and associated fumes used in the process can be hazardous to inhale or through contact with the skin.

The rifle barrel's crown is located at the muzzle end of a rifle barrel. It is the finished edge of the lands and grooves that release the projectile. If the bore is cleaned from the muzzle end, the cleaning rod can act as a file on the crown as it slides over the edges. The effects of this cleaning method can ultimately damage the bore's crown and destroy the rifle's accuracy. Therefore, the cleaning rod should always be driven from the breech end of the rifle barrel in the same direction that the bullet travels.

Many shotgun barrels can be removed from their actions. This is the best way to clean this type of barrel. Separation of the barrel from the action will eliminate the possibility of contaminating the action, or firing mechanism. Removing all traces of fouling from inside the shotgun barrel can reduce the possibility of corrosion and guarantee a long life for the barrel. Each time the shotgun is fired, it leaves many small particles inside the bore. These particles must be removed with a solvent that is formulated to remove the shot particles and gunpowder fouling. Scrubbing the barrel with a bore brush is a good way to remove the fouling. This process results in a very soiled area around the barrel due to the splattering effect of the large brush upon exiting the bore. Patches are also pushed to clean out the final traces of fouling, which spill out of the bore of the firearm barrel.

There is limited prior art to suggest ways to deal with the problems associated with cleaning firearms using the standard tools. The U.S. Pat. No. 5,983,550 prior art depicts a device that attaches to the muzzle of some barrels. This device is designed to keep the cleaning rod from exiting the barrel out of control. It offers no protection from the chemicals and debris that is generated during the firearm cleaning process.

The U.S. Pat. No. 5,815,975 suggests an accessory to guide the cleaning rod and another accessory to collect the debris generated during firearm cleaning. The debris collection feature requires an empty soda bottle be supplied in order to become operational. Thus, the device arrives as an incomplete unit. In addition, the soda bottle required for the device has a small diameter opening. This design limits the size of gun bore to which the prior art device can be attached. Rubber fingers are positioned in a circular position to grab the barrel, however they provide very little stability and poor alignment on the barrel. Prior art of the device also depicts a square cut out which allows for a small front sight blade on the barrel. This design limits the type of barrel that can be attached to the accessory.

Both of the previously mentioned prior art accessories are only useful when cleaning certain types of firearms from the breech. They cannot be used on firearm being cleaned from the muzzle end or breach end, or used on both ends of a gun barrel at the same time. These prior art patents can only be used on firearms with a very limited diameter of gun barrel and with only a small front blade sight. These prior art patent accessories cannot accommodate gun barrels of largely varying diameters with any type of sight system. In the case of the first prior art, part of the system requires the user to supply a used, screw on type pop bottle to render the device useful.

Thus, it is an object of the invention to provide a universal firearm cleaning system that comes complete as a functioning unit, ready to be used, without the need to acquire additional components.

It is another object of the invention to provide a universal firearm cleaning system that may be used on firearms with any diameter barrel.

It is another object of the invention to provide a fastener for the universal firearm cleaning system or other accessory that is quickly and easily removed from the barrel.

It is another object of the invention to provide a universal firearm cleaning system that can be installed on a barrel of a gun without interference from sighting system.

It is another object of the invention to provide a universal firearm cleaning system that may be attached to the gun barrel at the breech end or the muzzle end.

It is another object of the invention to provide a universal firearm cleaning system with the ability to be used as a shield only, with the end cap of the universal firearm cleaning system removed to allow access to the bore.

BRIEF SUMMARY OF THE INVENTION

The universal firearm cleaning system can be installed on virtually any type of gun barrel. It catches all cleaning patches, debris and splatter spilling out of a gun barrel during the firearm cleaning process. The preferred embodiment comprises a fastener for securing the firearm cleaning system to the barrel of a gun with a waste container for the collection of solvent and debris. The waste container has at least one removable end cap. The waste container further includes a second end cap that forms an opening for receiving a gun barrel when the fastener is secured to the barrel. The fastener includes a first and second tong with protruding tabs, in opposing adjacent positions that rotate about a rod through the tabs, acting as an axis and securing the fastener to support piece. A spring is positioned to rest against the first and second tong so as to exert a pressure to resist movement of the tongs from the adjacent or closed position. This spring pressure secures the fastener to the gun barrel when the gun barrel is situated between the tongs. By pinching the two tong handles together with the thumb and forefinger, the tongs can be easily opened. The portion of the tong that comes into contact with the gun barrel preferably has a pad to protect the gun barrel or tube from any damage. Once the cleaning procedure is complete, the universal firearm cleaning system can be quickly removed from the firearm. The waste container can then be opened to properly dispose of the debris.

BRIEF DESCRIPTION OF THE SEVERAL VIEWS OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
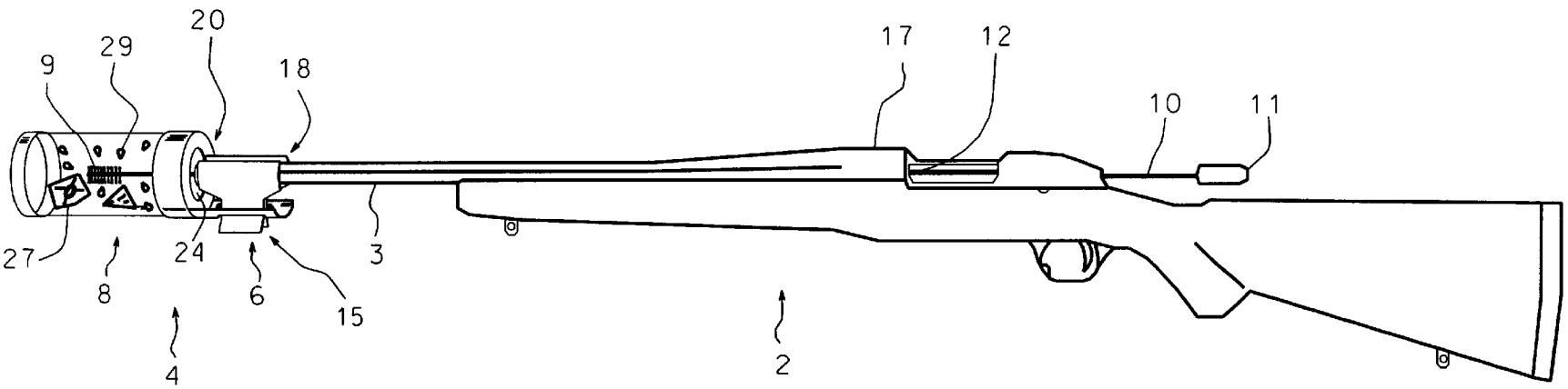
FIG. 1 illustrates a longitudinal view of a bolt-action firearm with the universal firearm cleaning system of the present invention installed on the muzzle.
Figure 2:
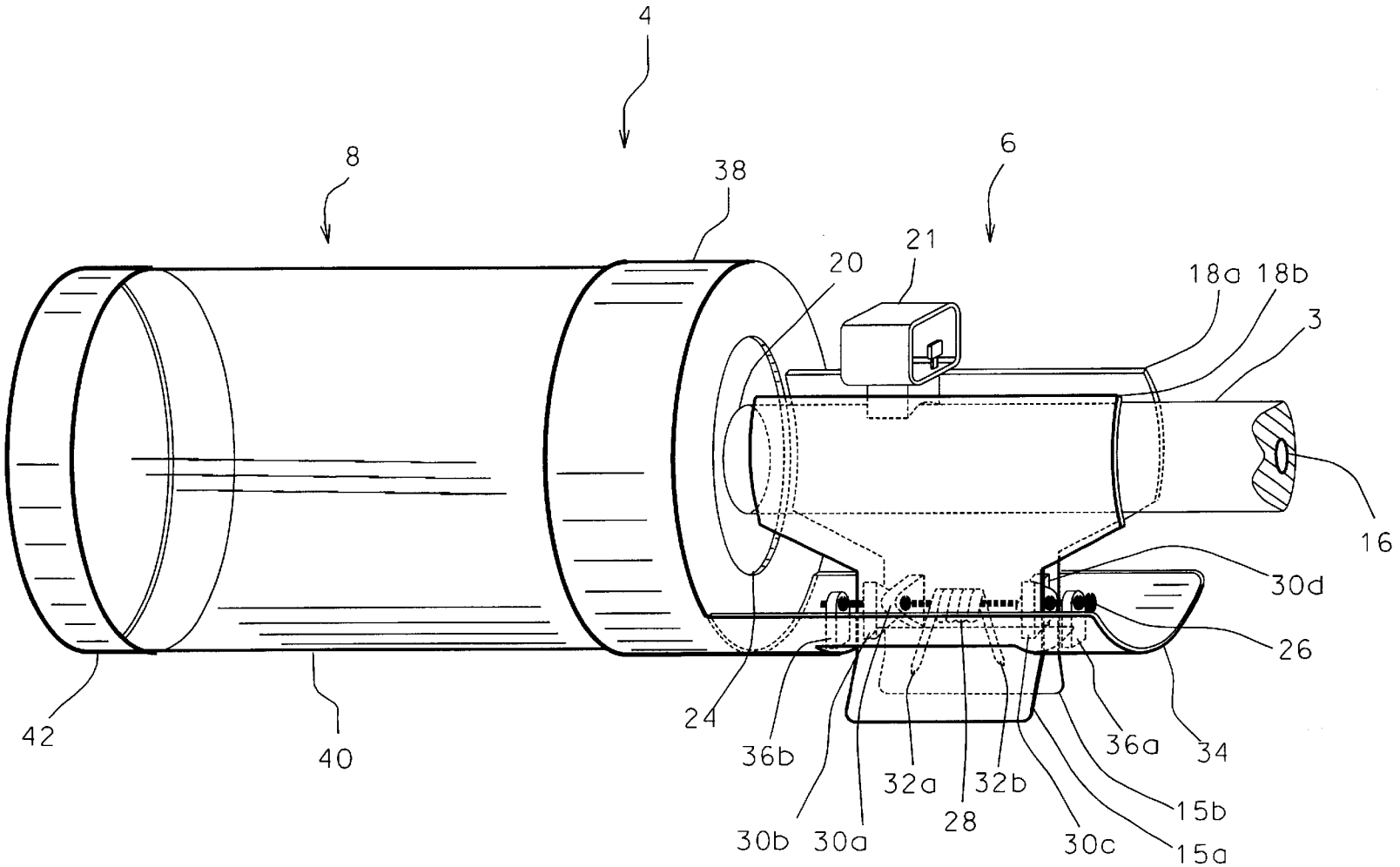
FIG. 2 illustrates a more detailed transparent view of the universal firearm cleaning system of the present invention installed on a rifle barrel with a hooded front sight.
Figure 3:
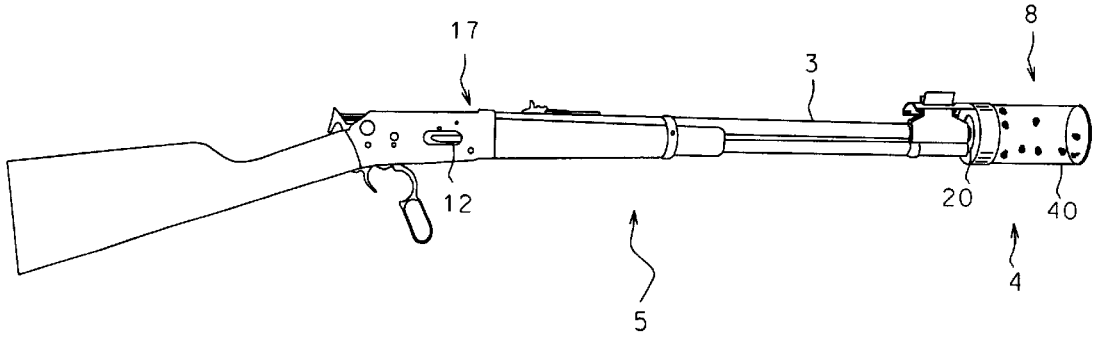
FIG. 3 illustrates use of the present invention when the cleaning system attached to the muzzle of a lever action rifle barrel with one end cap removed to facilitate access to the bore.

The present invention is best understood in relation to FIGS. 1 through 3 of the drawings, like numerals being used for like elements of the various drawings.

FIG. 1 illustrates a longitudinal view of a typical bolt-action rifle 2 with the firearm cleaning system 4 of the present invention installed. The firearm cleaning system 4 includes a barrel fastener assembly 6 and waste container assembly 8. In this illustration, the barrel fastener 6 is attached to the gun barrel 3 by pinching the handles 15 (referred to separately herein as handles 15*a* and 15*b* where appropriate) between your thumb and forefinger. The waste container 8 is attached to the barrel fastener 6, which is positioned over the muzzle 20 of the rifle 2. The barrel fastener 6 includes tongs 18 that can accommodate various diameters of gun barrels 3 and any type of sight system, as explained in detail below.

Once the bolt is removed from the bolt-action rifle 2, an appropriate bore cleaning guide should be inserted into the chamber 12. This will protect the chamber from debris as well as guide the cleaning rod 10. The cleaning rod 10 is then inserted thru the chamber 12 at the breech end 17 of the gun barrel 3. The chamber 12 leads to the bore of the gun barrel 3. The handle 11 should spin freely on the cleaning rod 10 and is used to push cleaning tips 9 through the bore 16. The cleaning rod tip 9 exits the muzzle 20 of the gun barrel 3. The muzzle 20 has been placed within the waste container 8 through an opening 24 on the fastener 6 end of the waste container. The fastener 6 has been installed on the muzzle 20 to secure the waste container 8 to the bolt-action firearm 2. Thus, when the cleaning rod tip 9 of the cleaning rod 10 is pushed through the bore 16 and out the muzzle 20, the waste container 8 catches all splattered solvent 29 and other debris 27 dripping from the muzzle 20.

FIG. 2 illustrates the cleaning system 4 in more detail. In this example, the fastener 6 attaches the waste container 8 to the barrel 3. The fastener 6 includes two tongs 18*a* and 18*b* that have been curved on the mating surfaces to readily clamp onto a cylindrical object. The curved mating surfaces of the tongs 18 preferably are padded (not shown) to prevent scratching to the gun barrel 3 when attached.

The tongs 18 (referred to separately herein as tongs 18*a* and 18*b* where appropriate) as situated in opposing adjacent positions. Tabs 30 (referred to separately herein as tabs 30*a*, 30*b*, 30*c* and 30*b* where appropriate) protrude outward from the tongs 18*a* and 18*b*. Each tong 18*a* and 18*b* has two tabs 30 so that tong 18*a* includes tabs 30*b* and 30*c* while tong 18*b* includes tabs 30*a* and 30*d*. The tabs 30 are positioned on each tong such that the sides of the tabs 30*a* and 30*b* are abutting when the tongs 18*a* and 18*b* are placed side by side. Similarly, the sides of tabs 30*c* and 30*d* are abutting when the tongs 18*a* and 18*b* are adjacent. Each tab 30 forms an opening that is aligned when tongs 18*a* and 18*b* are facing each other. A rod 26 fits through the openings formed on the tabs 30 and thus holds the tongs 18*a* and 18*b* together in alignment. The tongs 18*a* and 18*b* are able to rotate about the rod 26, with the rod 26 acting as an axis.

A torsion spring 28 is coiled around the rod 26 and positioned on the rod 26 so that the spring 28 is between tabs 30*a*, 30*b* and tabs 30*c*, and 30*d*. The spring 28 includes two legs 32 (referred to separately herein as legs 32*a* and 32*b* where appropriate). The first let 32*a* lays adjacent to tong 18*a* while leg 32*b* lays adjacent to tong 18*b*. The legs 32 thus act to exert opposing pressure on the tongs 18*a* and 18*b*. This pressure resists movement of the tongs 18*a* and 18*b* from their closed position. Another embodiment may exchange the torsion spring 28 for a compression spring (not shown) placed between the handles 15. A person skilled in the arts may suggest other ways to provide the spring pressure, however any type of spring may serve the same purpose. The tongs 18*a* and 18*b* are opened via finger pressure on the tong handles 15*a* and 15*b*. The opened tongs 18 can be placed about a gun barrel 3 and the handles 15 released. The pressure from the spring 28 holds the tongs 18*a* and 18*b* securely about the barrel 3. Thus, by opening and closing the tongs 18*a* and 18*b*, the fastener 6 may be easily secured to a gun barrel 3 and easily removed from the gun barrel 3. Hence the fastener 6 may be secured about gun barrels 3 with largely varying diameters—any diameter that fits within the tongs 18 when open. In addition, since the top of the tongs 18 are independent, they can accommodate any type of front sight mechanism from front blades (not shown) to hooded sights 21 (FIG. 2) to tall front sight pin systems (not shown).

The fastener 6 is attached to the waste container 8 by an elongated support piece 34 or fastener mount. The support piece 34 forms a rectangular or square opening. Tabs 36*a* and 36*b* are situated on each side of the rectangular opening of the support piece 34 and protrude upwards. The tabs 36*a* and 36*b* form openings in which the rod 26 also fits. The handles 15 of the tongs 18 are situated through the opening in the support piece 34. The formed openings on the tabs 36 on the support piece 34 align with the formed openings on the tabs 30 on the tongs 18. The rod 26 is positioned through tabs 30 and tabs 36 thus connecting the tongs 18 to the support piece 34. The rod 26 preferably has some type of head and/or other mechanism to keep it firmly in place between the tabs 36. Thus the support piece 34 becomes the fastener mount, which connects to the waste container 8.

The waste container 8 is attached to the support piece 34. The waste container 8 includes a first end cap 38. The support piece 34 is attached to the end cap 38. In the preferred embodiment, the support piece 34 and end cap 38 are formed together and are considered a single piece. The end cap 38 forms an opening 24 that is preferably circular to allow insertion of a gun barrel 3. The opening 24 formed in the end cap 38 should be of sufficient size to allow insertion of most sizes of gun barrels 3 without being too large to allow the debris and cleaning fluid to escape. Thus, the mechanism of the fastener 6 allows the universal firearm cleaning system 4 to be attached to virtually any firearm, providing distinct improvements over prior art.

The waste container 8 also includes a container bin 40. The container bin 40 is preferably a circular tube and at least partially transparent though a person of skill in the art would appreciate that any other shape, transparency or color of bin may serve the same purpose. The waste container bin 40 collects the debris, cleaning fluid and cleaning patches used during the cleaning process. Inclusion of the waste container 8 provides a distinct improvement over prior art in that the unit is ready to use and is self-contained.

In the preferred embodiment, end cap 38 is friction fit to the container bin 40. The end cap 38 in this example is formed to fit snugly about the sides of container bin 40 but may be removed by firmly sliding the end cap 38 away from the container bin 40. For example, if the end cap 38 has cylindrical sides that are formed with a circumference only slightly greater than the container bin 40, then the end cap 38 will fit securely around the container bin 40 but can be removed with reasonable outward force. A person of skill in the art would appreciate that the end cap 38 may be removably attached to the waste container bin 40 using other methods such as hooks, clips or screw-on type threads. In an alternative embodiment, the container bin 40 may be attached to the end cap 38 with another means to open and empty the container bin 40. In either case, the fastener 6 is attached to the waste container 8 which can be opened by some means and emptied of the cleaning debris 27 at a convenient time.

The waste container 8 also includes a second end cap 42. Similarly to end cap 38, second end cap 42 is also friction fit to the waste container bin 40. The second end cap 42 is formed to fit snugly about the sides of waste container bin 40 but may be removed by firmly sliding the second end cap 42 away from the container bin 40. A person of skill in the art would appreciate that the second end cap 42 may be removably attached using other methods (not shown) such as hooks, clips or screw-on threads. Another embodiment may feature an attached second end cap 42 with an access door (not shown) on the distal end of the container bin 40, which can be opened easily.

In FIG. 3, a lever action rifle 5 is depicted with a universal firearm cleaning system 4 attached to muzzle 20. With a lever action rifle 5, it is impossible to pass a cleaning rod, pushing from the breach end 17 of the barrel 3 without removing the barrel 3 from the gun 5. It is also undesirable to push the firing debris from the bore into the chamber 12 using a cleaning rod. The removable second end cap 42 of the preferred embodiment creates an important advantage in use of the waste container 8 on a lever action rifle 5. By removing the second end cap 42, a cable type cleaning system (not shown) may be pulled from the chamber 12 and out through the muzzle 20, thereby utilizing the waste container 8 as a shield. If you must use a cleaning rod driven from the muzzle end 20, it may be inserted through the container bin 40 and into barrel 3. The waste container 8 will shield against debris and fluid that splatters from the cleaning rod tip during the cleaning procedure. It is helpful to keep the barrel 3 level during the cleaning process with the second end cap 42 removed.

In addition, since the second end cap 42 is removable, the container bin 40 may easily be cleaned of debris. By removing the end cap 38 as well, the universal firearm cleaning system 4 may be completely disassembled for a thorough cleaning. With at least one entrance to the container bin 8, be it a removable second end cap 42 or an access door in the second end cap 42, the feature provides distinct improvements over prior cleaning systems.

Figure 4:
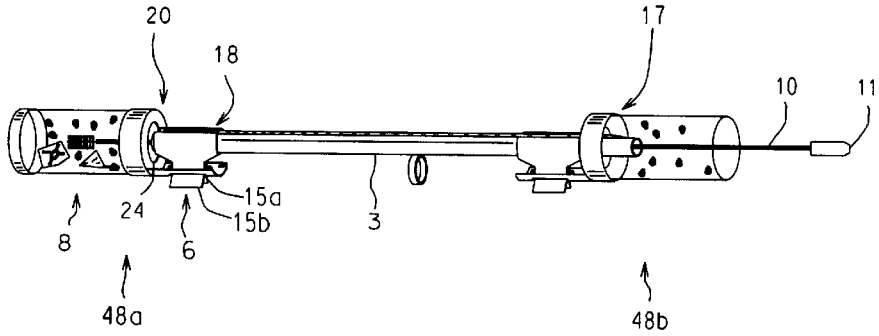
FIG. 4 illustrates another feature of the present invention with use of the cleaning system attached to the muzzle and breach end of a shotgun barrel at the same time with one end cap removed to facilitate access to the bore.

FIG. 4 illustrates another advantage of the present invention. Shotgun barrels can typically be removed from the action, which is the best way to clean this type of barrel 3. As depicted, one universal firearm cleaning system 48*a* is installed on the muzzle end 20. A second universal firearm cleaning system 48*b* is installed on the breach end 17 of a gun barrel 3. The first cleaning system 48*a* is attached to the muzzle 20 to collect the cleaning patches and splattering solvent. The second cleaning system 48*b* is attached to the breach end 17 of the gun barrel 3. The distal second end cap 42 of the second cleaning system 48*b* has been removed so that a cleaning rod 10 may easily be inserted into the gun barrel 3. This application is most useful when using a cleaning brush to clean the barrel 3. When the cleaning brush is removed from the bore 16, it flings cleaning solvent in every outward direction away from the cleaning brush. The universal firearm cleaning system 48*b* with the second end cap 42 removed acts as a shield, effectively containing the splattering chemicals. By using the two firearm cleaning systems 48*a* and 48*b* at the same time, the gun barrel 3 may be cleaned without distributing chemicals and a mess throughout the immediate area.

Although the Detailed Description of the invention has been directed to certain exemplary embodiments, various modifications of these embodiments, as well as alternative embodiments may be suggested to those skilled in the art. The invention encompasses any modifications or alternative embodiments that fall within the scope of the Claims.

I claim:

1. A firearm cleaning system for a firearm, the firearm having an elongated barrel surrounding and defining a bore and extending between a breech end and a muzzle end, a generally curvilinear outer surface concentric with the bore, and a longitudinal barrel axis coaxial with the bore, the firearm cleaning system comprising a first waste container having a container axis extending through an interior between a first opening adjacent the muzzle end and a second opening distal the muzzle end and opposite the first opening;

a first end cap covering the first opening and surrounding and defining an aperture adapted to receive the muzzle end;

a removable second end cap covering the second opening; and coupling means for coupling the waste container to the barrel.

2. The firearm cleaning system according to claim 1 wherein the container axis is substantially aligned with the barrel axis.

3. The firearm cleaning system according to claim 1 wherein the second end cap is substantially coaxial with the barrel axis.

4. The firearm cleaning system according to claim 1 wherein the coupling means comprises a fastener mount disposed on the first end cap and extending parallel to the barrel axis; and tongs pivotally coupled to the fastener mount and extending radially toward the barrel axis and adapted to grasp the barrel.

5. The firearm cleaning system according to claim 4 wherein the tongs further comprise opposed mating surfaces adapted to cooperate with the outer surface of the barrel to grasp and secure the cleaning system to the barrel.

6. The firearm cleaning system according to claim 5 wherein the tongs further comprise pads lining the mating surfaces.

7. The firearm cleaning system according to claim 4 wherein the tongs further comprise at least one biasing spring adapted to bias the tongs together and against the barrel.

8. The firearm cleaning system according to claim 7 and further comprising a plurality of tong tabs protruding from each tong, each of the tabs surrounding an aperture;

an axle rod extending through the aperture of each tab and coupled to the biasing spring;

fastener mount tabs disposed on the fastener mount and receiving the axle rod; and legs coupled to the biasing spring and bearing against the tongs.

9. The firearm cleaning system according to claim 4 wherein the tongs further comprise an operating handle coupled to each tong and extending through an aperture in the fastener mount.

10. The firearm cleaning system according to claim 1 and further comprising a second waste container disposed on the breech end of the barrel and having a second container axis, a second interior, a proximate opening adjacent to the breech end and a distal opening opposite the proximate opening, distal second end cap coupled to the distal opening and adapted to be removed; and coupling means for coupling the second container to the barrel such that the barrel axis and the container axes are substantially aligned.

11. The firearm cleaning system according to claim 10 wherein the second end cap on the first waste container provides access to the second interior through the first waste container and the barrel.

12. A firearm cleaning system for a firearm, the firearm having an elongated barrel surrounding and defining a bore and extending between a breech end and a muzzle end, a generally curvilinear outer surface concentric with the bore, a longitudinal barrel axis coaxial with the bore, and a sighting system located near the muzzle end, the firearm cleaning system comprising a waste container having, a container bin disposed on one end of the barrel and having an interior, a longitudinal bin axis, and a first opening adjacent to the barrel end;

access means for accessing the interior of the container bin;

a fastener mount extending parallel to the longitudinal axis of the container bin and parallel and offset the barrel axis disposed on the container bin beneath the gun barrel;

tongs pivotally coupled to the fastener mount and extending radially toward the gun barrel and adapted to grasp the gun barrel; and biasing means for biasing the tongs against the outer surface of the barrel.

13. The firearm cleaning system according to claim 12 wherein the access means comprises a second opening opposite the first opening; and a removable end cap covering the second opening.

14. The universal firearm cleaning system according to claim 12 wherein the biasing means comprises a handle disposed on the tong opposite the barrel and extending through the fastener mount; and spring means coupled between handles and the fastener mount for biasing the tongs together.

15. The universal firearm cleaning system according to claim 14 wherein the spring means comprises tongs tabs disposed on the tongs and adapted to cooperate with the corresponding mount adapted to receive a rod extending through the tong tabs and the mount tabs to comprise a pivot axle for the tongs; and a spring positioned to engage the handles and bias the tongs together.

16. The universal firearm cleaning system according to claim 12 wherein each of the tongs further comprise a concave portion disposed on the tongs adjacent the gun barrel; and a pad disposed on the concave portion on each tong adjacent the barrel.

17. An improved method of cleaning a firearm, the firearm having an elongated barrel surrounding and defining a bore and extending between a breech end and a muzzle end, a generally curvilinear outer surface concentric with the bore, and a longitudinal barrel axis coaxial with the bore, the method comprising providing a firearm cleaning system having a container bin adapted to couple to one end of the barrel, the bin further having a longitudinal bin axis, a first opening adjacent to the barrel;

a second opening opposite the first opening;

a removable end cap coupled to and covering the second opening; and coupling means for coupling the container bin to the gun barrel; then coupling the waste container to the muzzle end of the gun barrel, then providing a cleaning rod with a cleaning device attached to one end; then removing the end cap from the waste container, then repeatedly carrying out the following steps until the bore is clean:

inserting a cleaning rod through the breech end and the bore of the gun barrel until the cleaning device protrudes into the container, then withdrawing the rod until the cleaning device exits the breech end; then inspecting the cleaning device for stains and dirt, whereby the waste container traps splattering chemicals and debris as the cleaning rod protrudes into the container.

18. An improved method of cleaning a firearm, the firearm having an elongated barrel surrounding and defining a bore and extending between a breech end and a muzzle end, a generally curvilinear outer surface concentric with the bore, and a longitudinal barrel axis coaxial with the bore, the method comprising providing the firearm cleaning system having a plurality of waste containers, each waste container adapted to couple to the muzzle end and the breech end of the barrel, each waste container further having a longitudinal bin axis, a first opening adapted to couple the barrel;

a second opening opposite the first opening;

a removable end cap coupled to covering the second opening; and coupling means for coupling the waste container; then providing a cleaning rod with a cleaning device coupled to a rod end; then coupling a first waste container of the plurality of waste containers to the breech end; coupling a second waste container of the plurality of waste containers to the muzzle end; removing the removable end cap from the first waste container; then repeatedly carrying out the following steps until the bore is clean:

inserting the cleaning device through the first waste container into the bore; then pushing the rod into the bore until the cleaning device protrudes into the second waste container; then

21 withdrawing the rod and cleaning device back through the bore until the cleaning device exits the bore into the first waste container; then inspecting the cleaning device to determine if the bore is clean, whereby both waste containers trap splattering chemicals and debris as the cleaning device enters the container.

* * * * *